United States Patent [19]

Hultquist

[11] Patent Number: 4,507,951

[45] Date of Patent: Apr. 2, 1985

[54] FORCE PRODUCING AND TRANSMITTING APPARATUS

[76] Inventor: John V. Hultquist, 12861 Western Ave., Unit K, Garden Grove, Calif. 92641

[21] Appl. No.: 492,895

[22] Filed: May 9, 1983

[51] Int. Cl.[3] ..... B21D 1/12

[52] U.S. Cl. ..... 72/431; 72/705; 267/74

[58] Field of Search ..... 72/431, 432, 434, 705; 267/74; 188/316, 321.11

[56] References Cited

U.S. PATENT DOCUMENTS

| | | | |
|---|---|---|---|
| 1,567,517 | 12/1925 | Kisbey | 188/321.11 |
| 1,599,353 | 9/1926 | Albin | 267/74 |
| 1,814,632 | 7/1931 | Rohr | 72/434 |
| 2,835,154 | 5/1958 | Geller | 72/705 |
| 2,934,175 | 4/1960 | Schnitzer | 188/317 |
| 3,248,922 | 5/1966 | Downes | 72/431 |
| 3,492,855 | 2/1970 | Wylie | 72/705 |
| 3,549,143 | 12/1970 | Gilliam | 267/74 |
| 3,719,347 | 3/1973 | Wolgast et al. | 72/705 |
| 4,151,737 | 5/1979 | Specktor | 72/705 |

*Primary Examiner*—Lowell A. Larson

*Attorney, Agent, or Firm*—Dean P. Edmundson

[57] ABSTRACT

Apparatus is described which includes force-producing and force-transmitting means. The force-transmitting means comprises resilient plastic. The apparatus of the invention is especially useful in the straightening or shaping of metal, e.g., vehicle bodies and frames.

17 Claims, 8 Drawing Figures

FORCE PRODUCING AND TRANSMITTING APPARATUS

FIELD OF THE INVENTION

This invention relates to force producing and transmitting apparatus. More particularly, this invention relates to apparatus particularly useful in vehicle body and frame straightening techniques.

BACKGROUND OF THE INVENTION

In many businesses, and particularly in the business of vehicle body and frame repair, it is necessary to bend, pull and shape metal, either to restore it to its original shape or to put it into another desired shape. Although a number of manufacturers have made various devices for use in body and frame repair, such devices essentially employ the same technique. That is, they each include hydraulic ram, an upright post, and a working element such as a chain which is connected to the body or frame at one end and to the post at the other end. Pulling force is produced by the hydraulic ram and is transmitted to the chain and thence to the body or frame to be straightened.

Although a great amount of force can be produced by such previously known devices, and the force can be transmitted to the body or frame, such devices have certain inherent limitations and disadvantages. For example, the force transmitted to the body or frame part to be shaped is not constant. Rather, each time the hydraulic ram is operated the force transmitted to the body or frame varies from a great amount to a very small amount and then to a great amount again. This results from the nature of the operation of the hydraulic ram and also from the fact that the post and chain are made of metal and are extremely rigid under tension. Another problem inherent in the use of such devices is that the metal being straightened or shaped tends to harden when it is bent or shaped more than once, thereby weakening the metal. For example, when the metal is pulled a certain distance, then relaxed, and then pulled again, the metal tends to harden undesirably.

Another related problem associated with the use of such device is that the metal may be inadvertently pulled too far, thus requiring additional time and labor to push the metal back to the proper shape. Of course, this increases the tendency for the metal to harden undesirably and it also increases the possibility that the metal will be wrinkled or slightly mis-shaped.

A further problem associated with the use of such existing devices occurs when the chain, or the attachment of the chain to the body or frame, fails. Because of the tremendous pulling forces imposed on the chain, when it fails (i.e., breaks or detaches from the body or frame) the chain can become a lethal weapon when it snaps back toward the post away from the body or frame.

SUMMARY OF THE INVENTION

In accordance with the present invention there is provided force producing and transmitting apparatus which is particularly useful in straightening and shaping metal, e.g., body and frame straightening and shaping. Use of the apparatus results in high quality repairs or products in a safe and efficient manner.

The apparatus of the invention comprises, in one embodiment:

(a) a base member;
(b) an upright member supported by the base member;
(c) force-producing means;
(d) carriage means adapted to operably connect the force-producing means to the upright member;
(e) attachment means adapted to engage a working element; and
(f) resilient, plastic force-transmitting means adapted to transmit force from the force-producing means to the attachment means.

In another embodiment there is also included damping means operably connected between the attachment means and the force transmitting means.

In yet another embodiment the force-producing means is supported by the base member.

The apparatus of this invention transmits force to the metal to be straightened or shaped in a controlled, steady manner so that a continuous force is applied. Tension is always maintained on the chain or other attachment device so that the metal is pulled or bent in a continuous manner, thereby resulting in a smoother shape without weakening the metal.

In the preferred embodiment of the invention the damping means prevents dangerous snap-back of the chain or other attachment device in the event of failure.

BRIEF DESCRIPTION OF THE DRAWINGS

The invention is described in more detail hereinafter with reference to the accompanying drawings wherein like reference characters refer to the same parts throughout the several views and in which.

DETAILED DESCRIPTION OF THE INVENTION

Figure 1:
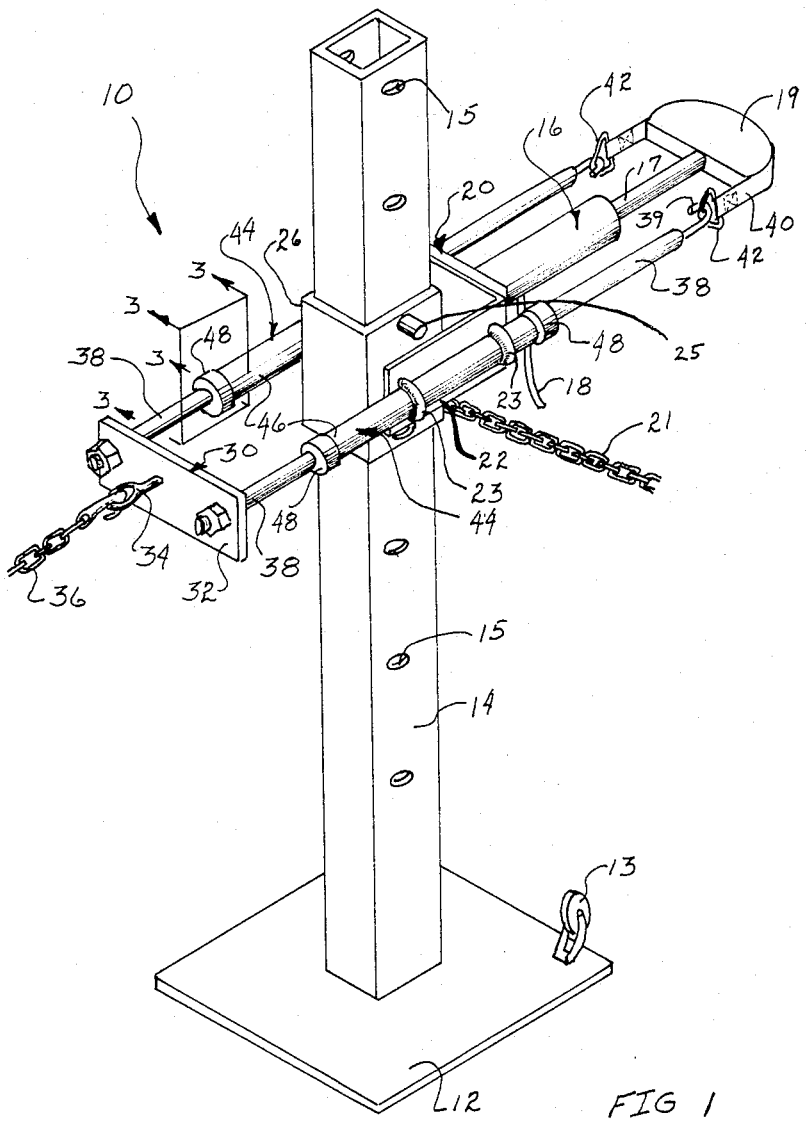
FIG. 1 is an isometric of one embodiment of the apparatus of the invention.
Figure 2:
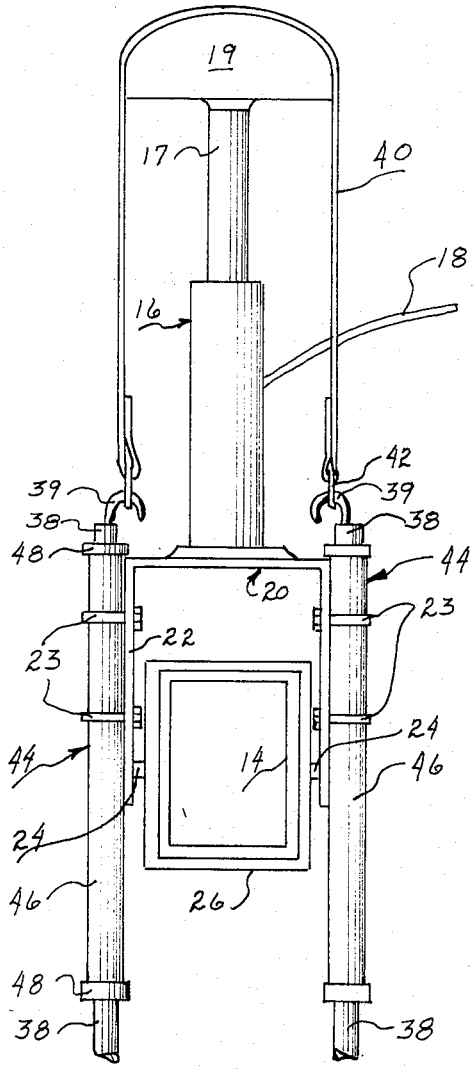
FIG. 2 is a top view of the apparatus of FIG. 1.

In FIGS. 1 and 2 there is shown a preferred embodiment of force producing and transmitting apparatus 10 comprising base member 12 supporting upright member 14 which is attached to the base member 12, for example, by welding or with bolts. Upright member 14 is preferably tubular (e.g., cylindrical or four sided hollow member) although it may be solid if desired. A typical size for a four-sided tubular member 14 is 3 inches by 4 inches and may be, for example, 4 or 5 feet high.

Base member 12 may include wheels or castors 13 to facilitate movement of apparatus 10 to a desired location by tilting the apparatus backward until castors 13 support the apparatus on the floor or other surface. Apertures 15 extend through upright member 14 and are spaced along its length.

Force-producing means 16 preferably comprises a hydraulically driven ram member 17. Hydraulic fluid is supplied to force producing means via pressure line 18.

The base of force-producing means 16 is attached to and supported by carriage means 20 comprising U-shaped yoke member 22, pins 24, and vertically moveable sleeve 26. Yoke member 22 pivots about pins 24 with respect to sleeve 26 and upright member 14. Pin 25 passes through an opening in sleeve 26 and a desired aperture 15 in upright member 14. Pin 25 may be removed in order to adjust the vertical position of sleeve 26 relative to upright member 14, and then pin 25 may be re-inserted in order to secure the position of sleeve 26.

Attachment means 30 comprises plate 32 which supports ring member 34 which is adapted to engage a working element 36. Plate 32 is affixed to one end of elongated rods 38 which may be, for example, 30 inches long. The opposite ends of rods 38 are connected, e.g., by means of hooks 39, to rings 42 at the opposite ends of resilient, plastic force-transmitting means 40 which is adapted to transmit force from force-producing means 16 via ram member 17 and the curved bearing surface on curved member 19.

Force-transmitting means 40 is resilient plastic which is capable of stretching slightly when a pulling force is applied to it. In this manner force-transmitting means 40 is capable of maintaining constant tension on working element 36 regardless of irregularities or discontinuities in force generated by force-producing means 16. This results in a steady and constant pulling force via working element 36 to the metal being straightened or shaped by apparatus 10. A constant tension on the metal prevents the metal from hardening undesirably during the straightening or shaping process.

Force-transmitting means 40 is preferably either made of nylon or polyester web strap or rope, such as the types commercially available from Adler Western, Inc. Preferably the strap or rope has a width of two inches or more and a thickness of about 0.25 inch or more. Most preferably the strap or rope has a capacity of 10 tons or more pulling strength. Of course, other sizes of straps and ropes may be used, if desired, depending upon the amount of force produced by the apparatus. Nylon straps are preferred because of their excellent stretchability and resiliency. A typical total length for the strap or rope is 30 inches.

Rods 38 are preferably part of damping means 44 affixed to carriage means 20 by means of U-bolts 23 secured to yoke member 22. Damping means 44 comprises tubular member 46 (having a length, for example, of about 14 inches), closure means 48 secured to each end of member 46, elongated rod members 38 passing through the bore of member 46, and piston 50 carried by rod member 38. Piston 50 (having a diameter of one inch) is adapted to snugly engage the interior of tubular member 46 (having an inside diameter of one inch). Fluid such as oil is contained within tubular member 46. O-ring 58 within closure means 48 prevents the fluid from leaking out of tubular member 46 while permitting rod member 38 to slide back and forth through member 46 during use of the apparatus. Threaded plug 54 may be removed in order for fluid to be added to tubular member 46.

The small longitudinal bore 52 (e.g., 1/16 inch in diameter) through piston 50 enables the fluid to pass slowly from one side of piston 50 to the other side as rod member 38 and piston 50 are moved relative to tubular member 46. Thus, as increasing force is applied by ram 17 to force transmitting means 40 and thence to rod members 38, this causes rod members 38 to move slowly relative to tubular members 46. As this happens the fluid within tubular members 46 is caused to pass through bore 52 from one side of piston 50 to the opposite side. In the event that chain 36 should break or become suddenly detached from the workpiece, the combination of piston 50 and the fluid within tubular member 46 prevents rod members 38 from rapidly or suddenly moving in a direction away from the workpiece which would result in undesirable and dangerous whipping of the chain.

Thus, the damping means provides safety of use of the apparatus. The damping means is adaptable to other apparatus in a similar manner in order to provide for safety of operation when tremendous forces are involved and the possibility of failure of the chain or other working element exists.

Because carriage means 20 may pivot with respect to upright member 14, the force producing means, force transmitting means, and attachment means will self-align with chain 36 as the pulling force is applied to the metal to be shaped or straightened. Accordingly, the pulling force is applied along a straight line which is very desirable.

Chain 21 attaches at one end to sleeve 26 at the rear of upright member 14 and at its other end to any suitable floor anchor means. Thus, chain 21 provides additional bracing support for upright member 14 when pulling force is applied to a workpiece by the apparatus of the invention.

Figure 4:
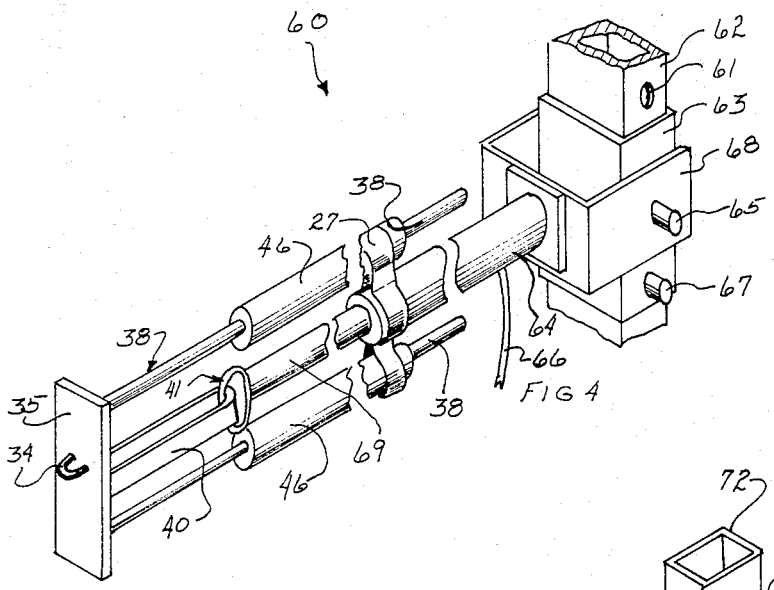
FIG. 4 is an isometric of a portion of another embodiment of apparatus of this invention.

In FIG. 4 there is shown another embodiment 60 of apparatus of this invention. In this embodiment the force-producing means 64 includes a pull type ram 69 which is pulled inward in response to high pressure hydraulic fluid supplied by hose 66. Force-producing means 64 is carried by yoke 68 which is pivotally mounted on pin 65 protruding from sleeve 63. Upright member 62 includes a series of openings 61 therethrough. Pin 67 may be inserted through sleeve 63 in order to secure sleeve 63 to upright member 62 at the desired vertical position.

Figure 3:
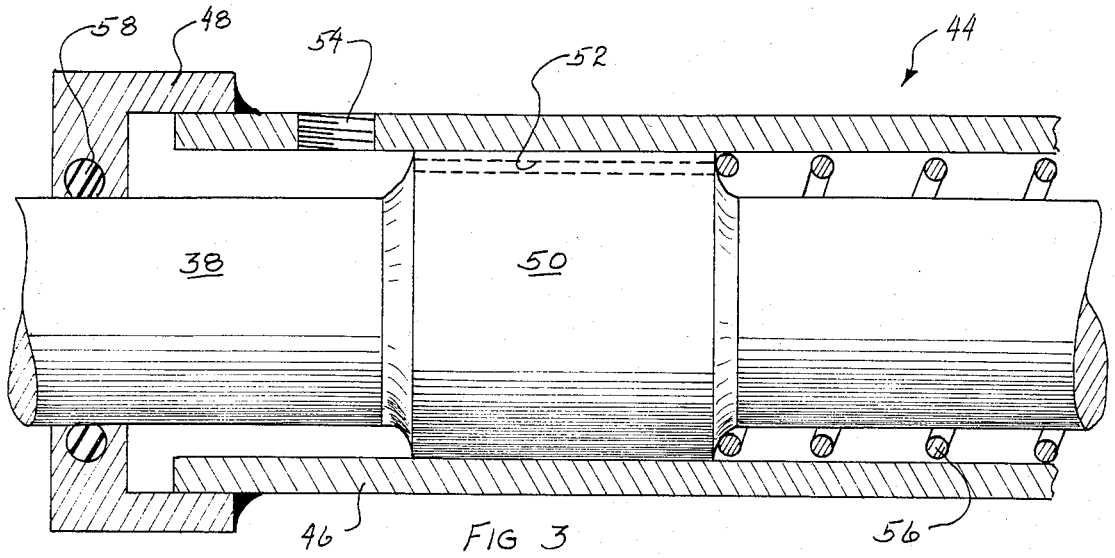
FIG. 3 is a partial cut-away view of damping means preferably used in the apparatus of this invention.

Force-transmitting means 40 is of the type described in connection with FIGS. 1 and 2. Means 40 is connected at each end to plate 35 and is looped through ring 41 carried by the outer end of ram member 69. Attachment means 34 is secured to plate 35 and is adapted to be connected to a working element such as a chain, for example, which is in turn connected to the workpiece. Rod members 38 are attached at one end to plate 35 and extend through tubular members 46 supported by force-producing means 64 via clamp means 27. Tubular members 46 are the same as described in connection with FIGS. 1–3.

In this embodiment the force producing means pulls against strap 40 which in turn pulls attachment means 34 and the working element. Tubular members 46 and rods 38, along with the piston on each rod 38 within each member 46, form damping means in the same manner as described above.

Figure 5:
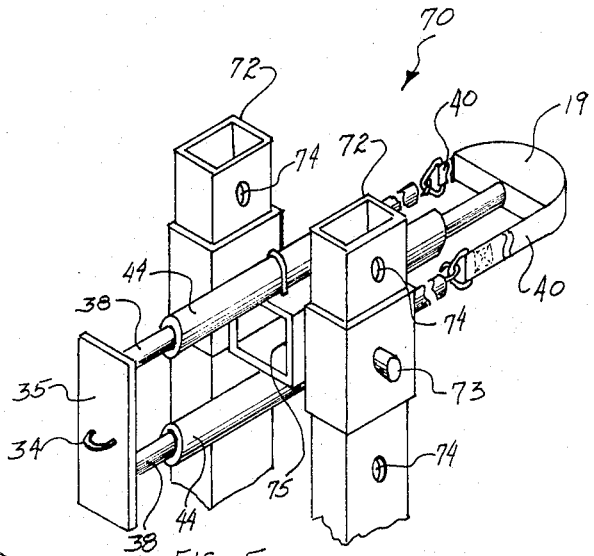
FIG. 5 is an isometric of a portion of another embodiment of apparatus of this invention.

In FIG. 5 there is shown another embodiment 70 in which the force-producing means 71 is pivotably supported between twin posts 72 by means of pin 73 passing through an aperture 74 in each post 72 and through yoke 75 to which means 71 is attached. The remainder of the apparatus corresponds to that described in FIGS. 1–3.

Figure 6:
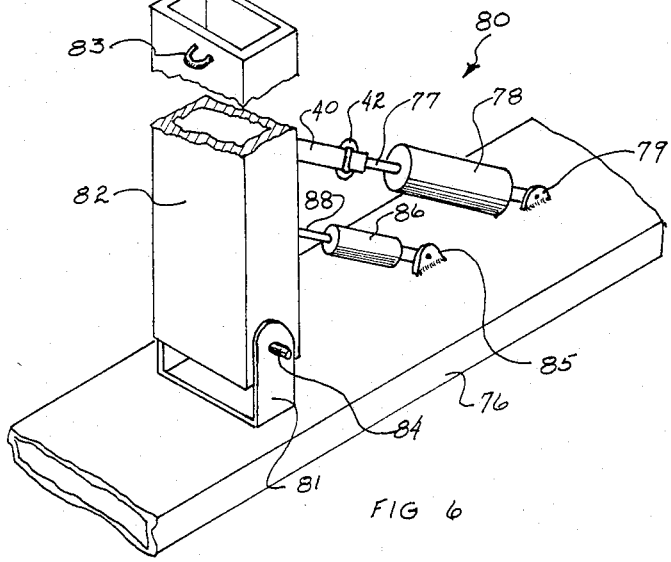
FIG. 6 is an isometric of another embodiment of apparatus of this invention.

In FIG. 6 there is shown another embodiment 80 of apparatus of the invention including force-producing means 78 which is secured by means of anchor 79 to base member 76. Ram member 77 is connected to force-transmitting means 40 of the type previously described by means of ring 42. The other end of force-transmitting means 40 is attached to upright member 82. Toward the upper end of member 82 there is secured ring 83 to which a chain or other working element may be attached. The lower end of upright member 82 is pivotably attached to mounting bracket 81 by means of pin 84.

The force-producing means 78 is adapted to exert a pulling force on ram member 77 and thence force transmitting means 40. Damping means includes tubular member 86 anchored at one end by anchor 85 carried on base 76. Rod member 88 is attached at one end to upright member 82, and the other end of member 88 extends into tubular member 86. A piston within member 86 of the type shown in FIG. 3 prevents rapid movement or whiplash of a chain attached to ring 83 in the event of failure.

Figure 7:
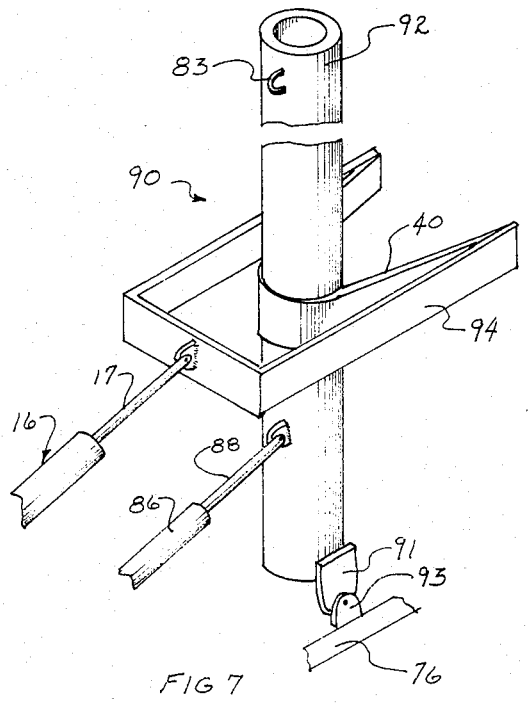
FIG. 7 is an isometric of yet another embodiment of apparatus of this invention.

In FIG. 7 there is shown another embodiment 90 of apparatus of this invention including upright member 92 pivotably attached at its lower end by bracket 91 to anchor 93 carried on base member 76. Force producing means 16 includes ram 17 in the same manner as described in connection with FIG. 1. The outer end of ram 17 is attached to U-shaped carriage means 94. Force-transmitting means 40 is secured at each of its ends to the carriage means 94, and means 40 is looped around upright member 92 in the manner shown. A working element is attached to ring 83. When force is exerted on ram 17 to push it against carriage means 94, force is transmitted via means 40 to upright member 92 and then to the working element. Damping means includes tubular member 86 and rod member 88, one end of which is secured to upright member 92.

Figure 8:
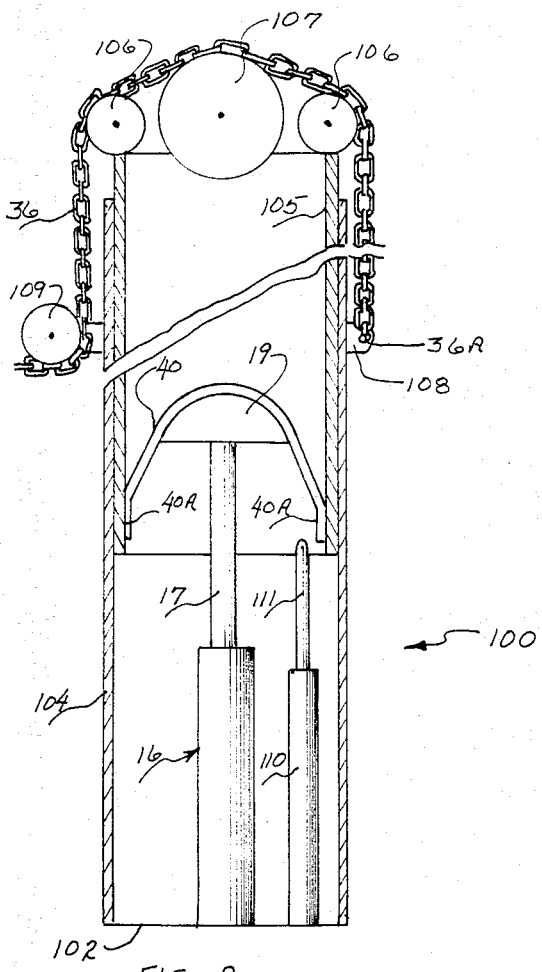
FIG. 8 is a partial cut-away view of still another embodiment of apparatus of this invention.

In FIG. 8 there is shown still another embodiment 100 of apparatus of this invention. In this embodiment the force producing means 16 is a push type as described in connection with FIG. 1 and includes ram member 17. The outer end of ram 17 carries curved member 19. Means 16 is supported at the base 102 of apparatus 100.

The upright member 104 includes a telescoping section 105 which is vertically moveable within section 104, as shown. Force transmitting means 40 of the type previously described extends over the curved surface of curved member 19 and is secured at its ends 40A to telescoping section 105. The upper end of section 105 includes rotatably supported pulleys 106 and 107 over which working element 36 is trained. One end 36A of the working element is secured on the back side of upright member 104 by securement means 108. On the front side of upright member 104 working element 36 passes under rotatably supported pulley 109. In this manner, as ram 17 is urged upwardly force is transmitted through means 40 to telescoping section 105. As section 105 is pushed upwardly against working element 36, the working element 36 is pulled toward upright member 104 and passes under pulley 109 and over pulleys 106 and 107. Damping means is provided by tubular member 110, which is supported on base 102, and rod member 111 which is attached at its upper end to telescoping section 105. The lower end of rod 111 extends into tubular member 110 and includes a piston of the type described in connection with FIG. 3. In the event of failure of working element 36, rapid movement of telescoping section 105 would be damped or retarded by virtue of the piston having to move slowly through fluid in tubular member 110.

Other variants are possible within the scope of this invention.

What is claimed is:

1. Force producing and transmitting apparatus adapted for use in body and frame straightening and shaping, said apparatus comprising:

(a) a base member, (b) an upright member supported by said base member, (c) force-producing means, (d) carriage means adapted to operably connect said force-producing means to said upright member, (e) attachment means adapted to engage a working element, (f) resilient, plastic force-transmitting means adapted to transmit pulling force from said force-producing means to said attachment means; and (g) damping means operably connected between said attachment means and said force transmitting means.

2. Force producing and transmitting apparatus in accordance with claim 1, wherein said force producing means comprises a hydraulically powered ram member.

3. Force producing and transmitting apparatus in accordance with claim 1, wherein said carriage means is vertically adjustable on said upright member.

4. Force producing and transmitting apparatus in accordance with claim 3, wherein said carriage means is pivotable with respect to said upright member.

5. Force producing and transmitting apparatus in accordance with claim 1, wherein said damping means comprises:

(a) a tubular member, (b) closure means secured to each end of said tubular member, (c) an elongated rod member extending through said tubular member and said closure means, said rod member being moveable with respect to said tubular member and said closure means, (d) piston means carried by said rod member, said piston means being adapted to snugly engage the interior of said tubular member, (e) fluid means contained within said tubular member, wherein said piston means is adapted to permit said fluid to travel from one side of said piston means to the other side thereof within said tube when said rod member moves relative to said tubular member.

6. Force producing and transmitting means in accordance with claim 5, wherein said fluid means comprises oil.

7. Force producing and transmitting means in accordance with claim 5, wherein said piston means includes a longitudinal bore therethrough.

8. Force producing and transmitting means in accordance with claim 5, further comprising a spring member within said tubular member.

9. Force producing and transmitting apparatus in accordance with claim 1, wherein said force transmitting means is selected from elongated nylon and polyester straps.

10. Force-producing and transmitting apparatus adapted for use in body and frame straightening and shaping, said apparatus comprising:

(a) a base member, (b) an upright member supported by said base member, (c) force producing means supported by said base member, (d) attachment means carried by said upright member adapted to engage a working element, (e) resilient, plastic force-transmitting means adapted to transmit force from said force-producing means to said upright member, and (f) damping means operably connected between said base and said upright member.

11. Force producing and transmitting apparatus in accordance with claim 10, wherein said force producing means comprises a hydraulically powered ram member.

12. Force producing and transmitting apparatus in accordance with claim 10, wherein said upright member is pivotably attached to said base member.

13. Force producing and transmitting apparatus in accordance with claim 10, wherein said upright member comprises a telescoping section which is adapted to be urged against a working element by said force producing means.

14. Force producing and transmitting apparatus in accordance with claim 13, wherein said telescoping section has an upper end and a lower end, wherein said upper end rotatably supports pulley means and wherein said lower end is operably connected to said force transmitting means.

15. Force producing and transmitting apparatus in accordance with claim 10, wherein said damping means comprises:

(a) a tubular member, (b) closure means secured to each end of said tubular member, (c) an elongated rod member extending through said tubular member and said closure means, said rod member being moveable with respect to said tubular member and said closure means (d) piston means carried by said rod member, said piston means being adapted to snugly engage the interior of said tubular member, (e) fluid means contained within said tubular member, wherein said piston means is adapted to permit said fluid to travel from one side of said piston means to the other side thereof within said tube when said rod member moves relative to said tubular member.

16. Force producing and transmitting means in accordance with claim 15, further comprising a spring member within said tubular member.

17. In force-producing and transmitting apparatus of the type adapted for use in body and frame straightening and shaping, wherein force producing means is adapted to exert force on an object by means of a working element, wherein the improvement comprises (a) resilient, plastic force transmitting means adapted to transmit pulling force from said force-producing means to said working element, and (b) damping means operably connected between said working element and said force-transmitting means.

* * * * *